US008242870B1

(12) United States Patent
Folker

(10) Patent No.: US 8,242,870 B1
(45) Date of Patent: Aug. 14, 2012

(54) MAGNETIC COMPONENT WITH A NOTCHED MAGNETIC CORE STRUCTURE

(75) Inventor: Donald Folker, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 46 days.

(21) Appl. No.: 12/582,567

(22) Filed: Oct. 20, 2009

Related U.S. Application Data

(60) Provisional application No. 61/168,877, filed on Apr. 13, 2009.

(51) Int. Cl.

| | |
|---|---|
| ***H01F 27/30*** | (2006.01) |
| ***H01F 27/02*** | (2006.01) |
| ***H01F 27/29*** | (2006.01) |
| ***H01F 27/28*** | (2006.01) |

(52) U.S. Cl. ..... 336/198; 336/83; 336/192; 336/195; 336/199

(58) Field of Classification Search ..... 336/192–199
See application file for complete search history.

(56) References Cited

U.S. PATENT DOCUMENTS

| | | | | |
|---|---|---|---|---|
| 4,424,504 | A | 1/1984 | Mitsui et al. | |
| 5,140,291 | A * | 8/1992 | Mulder et al. | 336/198 |
| D384,333 | S | 9/1997 | Suzuki | |
| D463,365 | S | 9/2002 | Sakai et al. | |

FOREIGN PATENT DOCUMENTS

| | | |
|---|---|---|
| JP | 04085910 | 3/1992 |
| JP | 05021232 | 1/1993 |

* cited by examiner

*Primary Examiner* — Anh Mai
*Assistant Examiner* — Ronald Hinson
(74) *Attorney, Agent, or Firm* — Waddey & Patterson, P.C.; Mark J. Patterson; Matthew C. Cox

(57) ABSTRACT

A magnetic component having a magnetic core structure includes a core body with a notched region for reducing non-essential core material. The notched region has the cross-sectional shape of a trapezoid and includes two notch walls separated by a middle wall. The notch walls are each oriented at an obtuse angle relative to the middle notch wall. The core structure reduces the cost of manufacture and the size of the magnetic component by eliminating non-essential core material from regions of the core that have little or no impact on the magnetic performance of the component. The desired magnetic flux path in the component remains substantially unaffected by the removal of the non-essential core material. The body of the core may also include one or more angled shoulders positioned at the corners of the core body to further eliminate non-essential core material.

3 Claims, 6 Drawing Sheets

MAGNETIC COMPONENT WITH A NOTCHED MAGNETIC CORE STRUCTURE

CROSS-REFERENCES TO RELATED APPLICATIONS

This application is a Non-Provisional Utility application which claims the benefit of co-pending U.S. Provisional Patent Application Ser. No. 61/168,877 filed Apr. 13, 2009 entitled "LOW COST FERRITE "E" CORE STRUCTURE" which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to a magnetic component having a core structure for guiding and concentrating a magnetic field and specifically to a magnetic core structure designed for achieving a desired magnetic flux pattern using a minimized amount of core material to reduce size and manufacturing cost.

More particularly, this invention pertains to magnetic components having ferrite cores for guiding and concentrating magnetic fields. Such components are found in many consumer and industrial electronic devices and are an important part of the electronics industry. Magnetic components of this type, such as transformers and inductors, generally include one or more coils of conductive wire wound around a ferrite core. As current passes through the coil, a magnetic field is generated around the wire. The magnetic field is then concentrated and strengthened by the ferrite core as magnetic flux passes through the core. The shape and design of the core greatly influences the magnetic and electronic performance of the component.

A common core design includes three rectangular solid legs extending from a rectangular solid body, forming the shape of an "E". Traditional E cores are used in known electrical components. In a basic transformer, for example, the traditional E core is generally positioned with the legs abutting a separate ferrite structure, commonly a rectangular ferrite solid or a separate E core, to form a magnetic flux path through the legs and body of the core and the separate structure. A conductive coil is positioned around the middle leg of the core. The traditional configuration allows magnetic flux to pass through the legs of the core in a closed loop when current is passed through the conductor. Traditional E cores are usually made of ferrite, but may include additional materials.

The traditional E core design is widely used because its simple design makes it easy to manufacture at relatively low cost. Additionally, the design of the traditional E core yields reliable performance because the magnetic flux path follows a uniform route through the legs and body of the core. Yet, despite its design simplicity and convenience for low-cost manufacture, the traditional E core includes non-essential core material in core regions where little or no magnetic flux is present. Non-essential core regions have a negligible effect on the magnetic performance of the core because such regions do not constitute part of the magnetic flux path. The inclusion of non-essential core material in traditional E cores needlessly raises both the cost of manufacture and the overall size of magnetic components.

Others have attempted to produce magnetic components having modified core designs that remove non-essential core material. These attempts include notches on the core body having circular, rectangular or triangular profiles or angled corners. Previous attempts have produced cores that include complex and three-dimensional curvilinear geometries. While more complex curvilinear cores, including pot cores, offer benefits of reduced non-essential core material and desired core performance, they require more expensive and time consuming design and manufacturing processes. The additional cost and geometrical complexity of prior art cores renders them unsuitable for use as a low cost alternative to the traditional E core design.

Accordingly, there is a need in the art for providing a magnetic component having a magnetic core structure that reduces both overall component size and manufacturing cost by eliminating non-essential core material while maintaining desirable magnetic and electrical performance characteristics.

BRIEF SUMMARY OF THE INVENTION

The present invention provides a magnetic component for an electronic circuit that includes a magnetic core structure for guiding a magnetic field, the core structure requiring a reduced amount of material while maintaining desired performance characteristics. The magnetic core structure includes a core body and three legs extending from the core body. The core body includes a notched recess generally having the cross-sectional profile of a trapezoid. The notched recess eliminates non-essential core material that has little or no effect on the magnetic performance of the core. The notched recess includes a first notch wall, a second notch wall and middle notch wall. The first and second notch walls are each oriented at an obtuse angle relative to the middle notch wall. The core body may additionally include one or more chamfered shoulders positioned on the core body to further remove non-essential core material.

It is therefore a general object of the present invention to provide a magnetic component including a core structure having non-essential core material removed.

Another object of the present invention is to provide a magnetic component including a core structure having a design that reduces the cost of core manufacture by using less core material.

Yet another object of the present invention is to provide a magnetic component including a core structure that maintains desired magnetic and electronic performance by providing a sufficient magnetic flux path while eliminating unnecessary core material.

Still yet another object of the present invention is to provide a magnetic component including a core structure having reduced volume that can accommodate the same amount of magnetic flux as a core having a larger volume.

A further object of the present invention is to provide a magnetic component including a core structure designed for reducing the amount of core material while maintaining a desired cross-sectional profile in the magnetic flux path.

Still yet another object of the present invention is to provide a magnetic component including a core structure with a uniform flux path.

Another object of the present invention is to provide a magnetic component including a core structure that can be used for multiple applications.

Numerous other objects, features and advantages of the present invention will be readily apparent to those skilled in the art, upon a reading of the following disclosure, when taken in conjunction with the accompanying drawings.

DETAILED DESCRIPTION OF THE INVENTION

Figure 1:
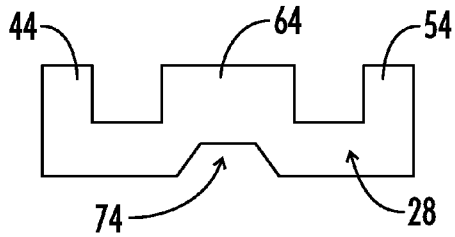
FIG. 1 is a top view of a magnetic core structure consistent with the present invention.
Figure 2:
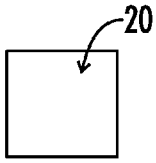
FIG. 2 is an end view of the magnetic core structure of FIG. 1.
Figure 3:
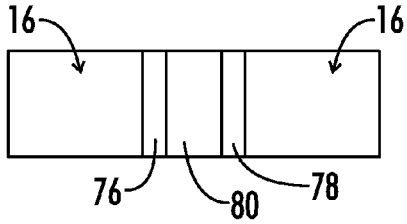
FIG. 3 is a side view of the magnetic core structure of FIG. 1.
Figure 4:
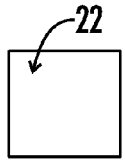
FIG. 4 is an end view of the magnetic core structure of FIG. 1.
Figure 5:
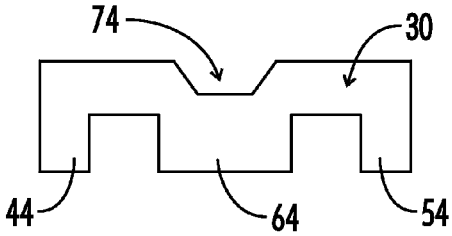
FIG. 5 is a bottom view of the magnetic core structure of FIG. 1.
Figure 6:
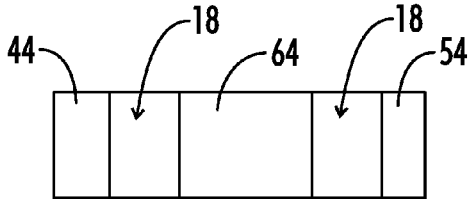
FIG. 6 is a side view of the magnetic core structure of FIG. 1.

Referring now to the drawings, FIGS. 1-7 illustrate several views of one embodiment of a core structure for a magnetic component consistent with the present invention. One embodiment includes a core structure 10 having a core body 14, a first leg 44 having a top surface 46, a second leg 54 having a top surface 56 and a center winding leg 64 having a top surface 66. The core body 14 includes a first side surface 16, a second side surface 18, a top surface 28, a bottom surface 30, a first end surface 20 and a second end surface 22. The core 10 may be formed in a variety of ways, including molding, casting, extruding, cutting or sintering. In one embodiment, the core 10 is made of a ferrite. In other embodiments the core 10 can be made of other material or combinations of materials having magnetic permeability.

Figure 7:
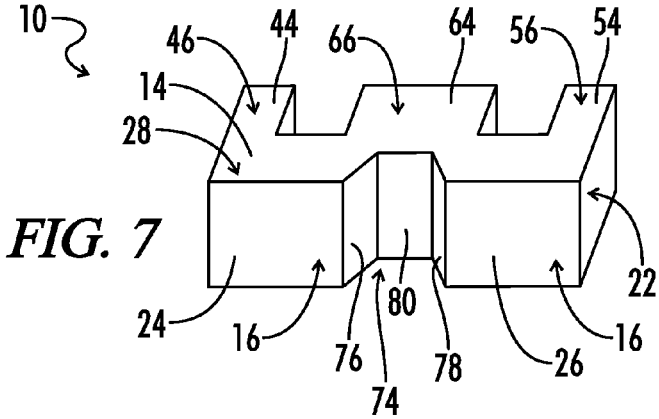
FIG. 7 is a perspective view of the magnetic core structure of FIG. 1.

Referring to FIG. 7, in one embodiment, the first side surface 16 may be divided into a first side surface primary region 24 and a first side surface secondary region 26 by a notched recess 74. The notched recess 74 includes a first notch wall 76, a second notch wall 78 and a middle notch wall 80. Each notch wall extends from the top surface 28 of the core body 14 to the bottom surface 30 of the core body 14. The notched recess 74 eliminates non-essential material from the core body 14 while maintaining sufficient core material in the core body 14 to accommodate a desired amount of magnetic flux. Non-essential core material is defined as material in the core body 14, first leg 44, second leg 54 or center winding leg 64 that is not part of the desired magnetic flux path for a component operating condition. In one embodiment, the notched recess 74 may be positioned on the core body 14 opposite the center winding leg 64. In alternative embodiments, the notched recess 74 may be positioned elsewhere on the first side surface 16 of the core body 14.

Figure 8:
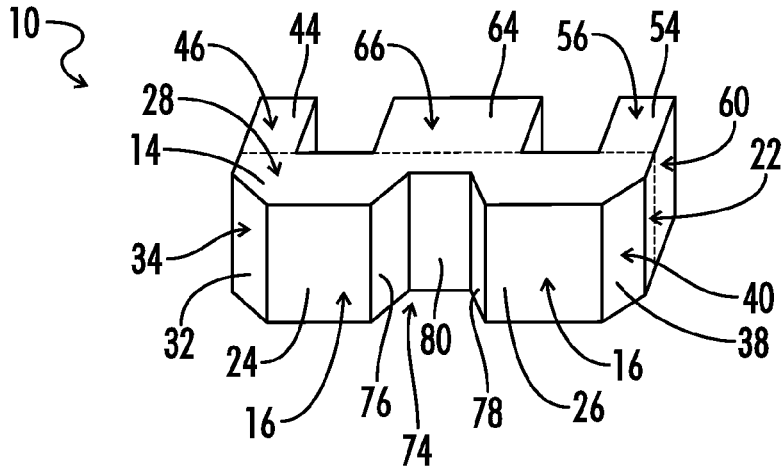
FIG. 8 is a perspective view of a magnetic core structure consistent with the present invention.
Figure 9:
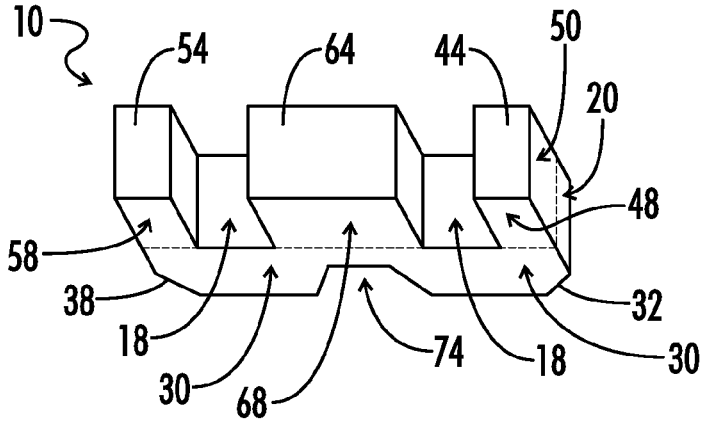
FIG. 9 is a perspective view of the magnetic core structure of FIG. 8.

Referring now to FIG. 8 and FIG. 9, one embodiment of a magnetic core structure 10 embodying the principles of the present invention is shown. The core body 14 may include a first shoulder 32. The first shoulder defines a first shoulder surface 34 positioned between the first end surface 20 and the first side surface 16 of the core body 14. Further consistent with the present invention, a second shoulder 38, defining a second shoulder surface 40 may be positioned on the core body 14 between the first side surface 16 and the second end surface 22. The first shoulder 32 and the second shoulder 38 allow further removal of non-essential core material.

Referring again to FIG. 8 and FIG. 9, the core body 14 may include a plurality of legs extending from the second side surface 18 of the core body 14. The first leg 44, center winding leg 64 or second leg 54 may share one or more surfaces with the core body 14. In one embodiment, shown in FIG. 8, the top surface 46 of the first leg 44 extends coextensively with the top surface 28 of the core body 14. As shown in FIG. 9, the end surface 50 of the first leg 44 coextends with the first end surface 20 of the core body 14, and the bottom surface 48 of the first leg 44 coextends with the bottom surface 30 of the core body 14. Referring back to FIG. 8, the second leg 54 shares a top surface 56 with the top surface 28 of the core body 14 and an end surface 60 with the second end surface 22 of the core body 14. As shown in FIG. 9, the bottom surface 58 of the second leg 54 coextends with the bottom surface 30 of the core body 14. Referring back to FIG. 8, the center winding leg shares a top surface 66 with the top surface 28 of the core body 14 and, as shown in FIG. 9, a bottom surface 68 with the bottom surface 30 of the core body 14.

Figure 10:
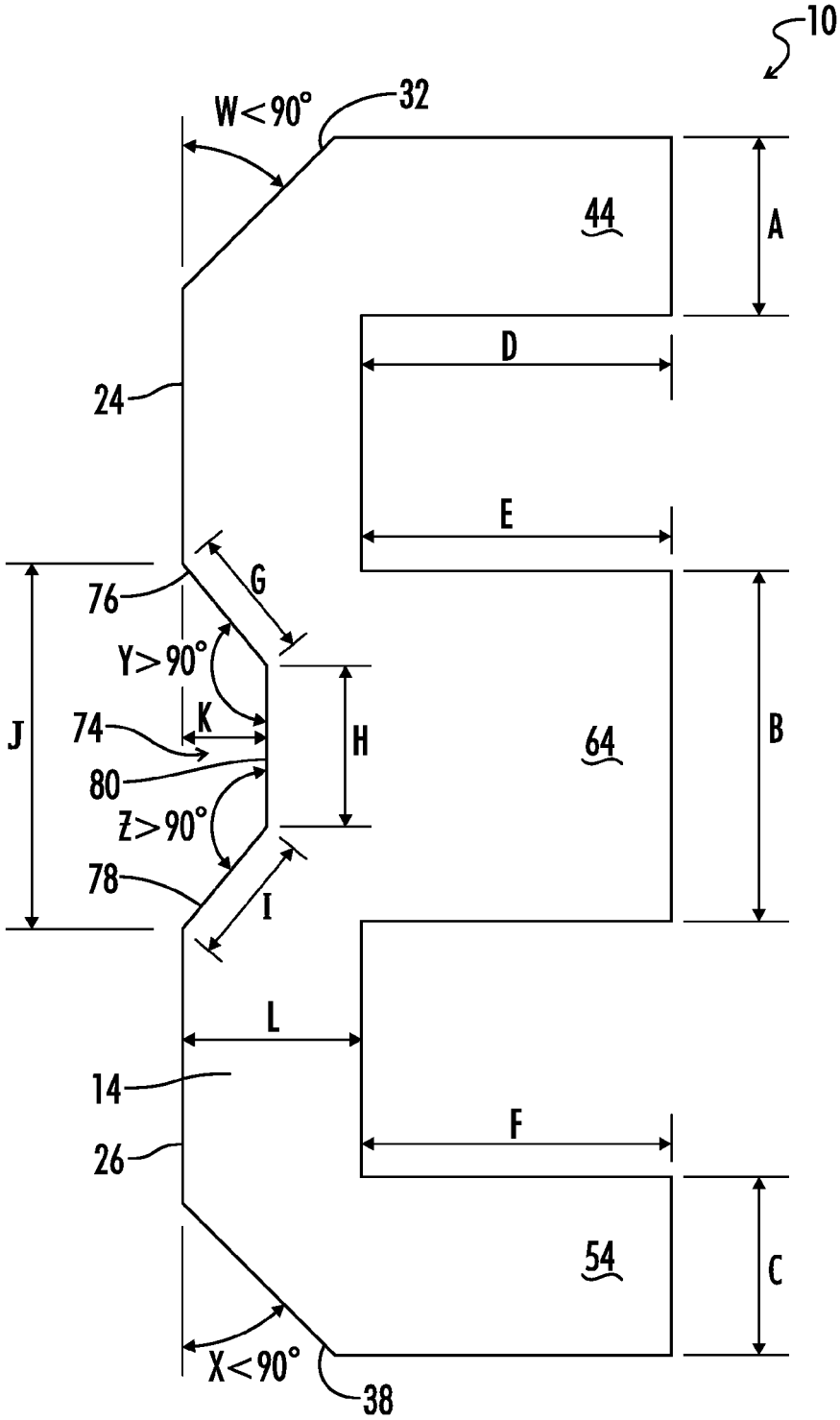
FIG. 10 is a plan view of the magnetic core structure of FIG. 9.

Referring now to FIG. 10, the first shoulder 32 is oriented at an angle W and the second shoulder 38 is oriented at an angle X. Angle W is defined as the angle between the first shoulder 32 and the first side surface primary region 24. Angle X is defined as the angle between the second shoulder 38 and the first side surface secondary region 26. Angles W and X are less than 90 degrees. In one embodiment, angles W and X may range between 30 and 60 degrees. In another embodiment, angles W and X are substantially equal.

Referring further to FIG. 10, the first wall 76 of the notched recess 74 is oriented at angle Y, and the second notch wall 78 is oriented at angle Z. Angle Y is defined as the angle between the first notch wall 76 and the middle notch wall 80. Angle Z is defined as the angle between the second notch wall 78 and the middle notch wall 80. Angles Y and Z may range between 91 and 179 degrees, and in one embodiment may be between 120 and 150 degrees. In one embodiment, angle Y is substantially similar to angle Z. In other embodiments, angle Y may be smaller or larger than angle Z.

Figure 11A:
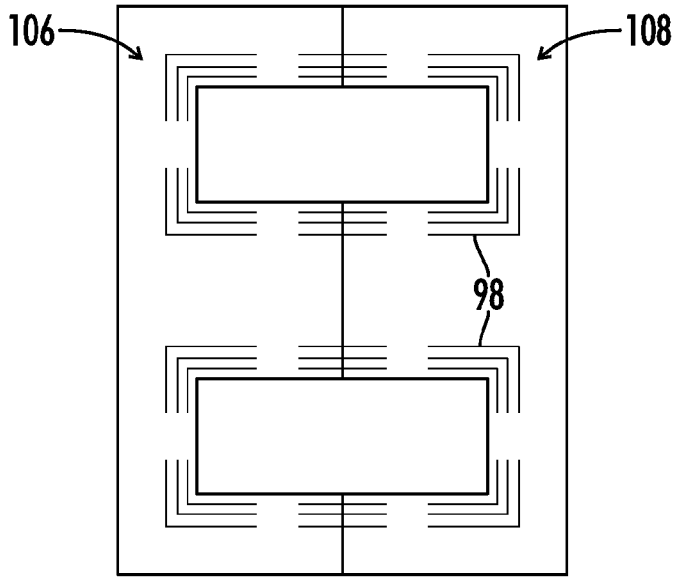
FIG. 11A (PRIOR ART)
FIG. 11A is a plan view of a magnetic component including a prior art magnetic core structure
Figure 11B:
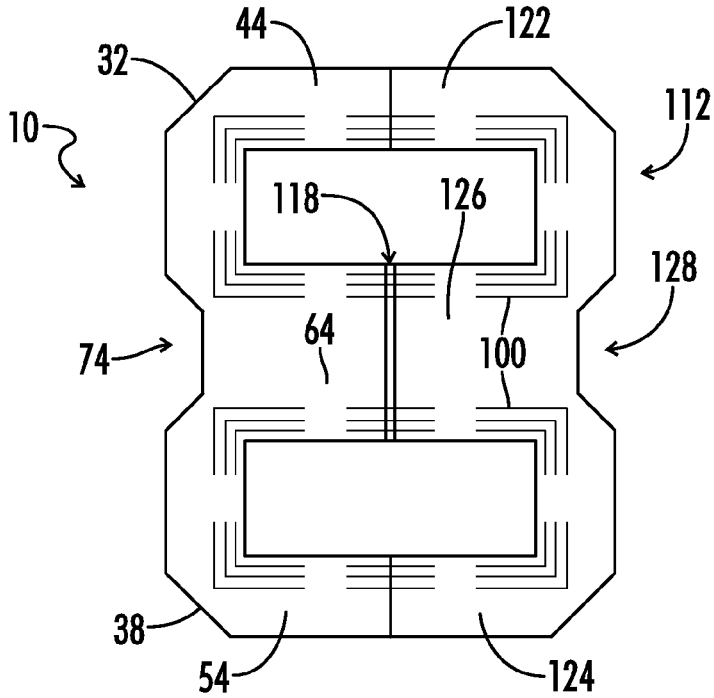
FIG. 11B is a plan view of a magnetic component including a magnetic core structure consistent with the present invention.

Referring now to FIG. 11A, a prior art magnetic component including a traditional E core is shown in a known configuration, wherein a first E core 106 is positioned adjacent to a second E core 108. In the presence of a magnetic field generated by the flow of current through a nearby conductor, magnetic flux 98 travels in a closed loop through the first E core 106 and the second E core 108. Referring now to FIG. 11B, an embodiment of a magnetic component consistent with the present invention is shown. A first core 10 having a notched recess 74, a first shoulder 32 and a second shoulder 38 is positioned adjacent to a second core 112 also having a notched recess 128. The second core 112 includes a first leg 122, a second leg 124 and a center winding leg 126. As shown in FIG. 11B, the magnetic flux pattern 100 is minimally affected by the presence of the notched regions 74,128, the first shoulder 32 or the second shoulder 34 when compared to the magnetic flux pattern 98 of the prior art configuration shown in FIG. 11A.

Referring further to FIG. 11B, in one embodiment an air gap 118 may be present between the center winding leg 64 of the first core 10 and the center winding leg 126 of the second core 112. Another embodiment provides uniform contact between the center winding legs 64, 126. Other embodiments may include partial contact between the center leg 64 of the first core 10 and the center leg 126 of the second core 112.

Referring again to FIG. 10, in one embodiment consistent with the present invention, the shape of the notched recess 74 is defined by the width of the middle notch wall, H, the width of the first notch wall, G, the width of the second notch wall, I, the depth of the notch, K, and the outer width of the notch, J. In one embodiment, the width, H, of the middle notch wall 80 extends at least one-half the width, B, of the center winding leg 64. In another embodiment, the width, H, of the middle notch wall 80 is at least one-half the outer width, J, of the notched recess 74. Consistent with the present invention, the outer width, J, of the notched recess 74 may be equal to the width, B, of the center winding leg 64. Further consistent with the present invention, the width, H, of the middle notch wall 80 may extend at least one millimeter. In another embodiment consistent with the present invention, the notch depth K extends less than one-half the width, L, of the core body 14.

Figure 12:
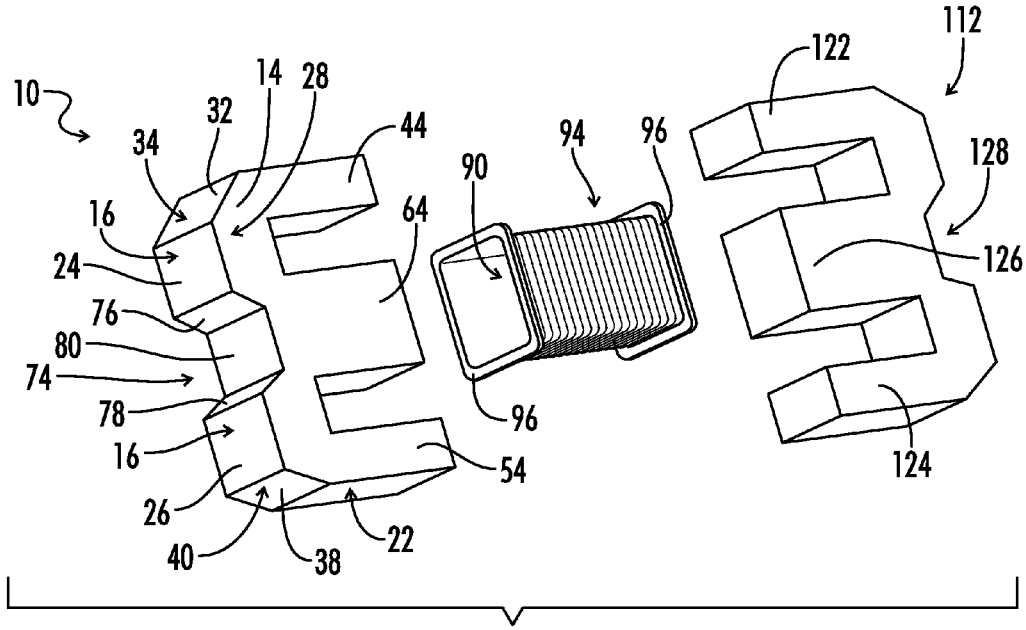
FIG. 12 is an exploded view of a magnetic component consistent with the present invention.

Referring now to FIG. 12, an exploded view of a magnetic component embodying the principles of the present invention is illustrated, including a first core 10, a second core 112 and a conductive coil 94. The conductive coil 94 is positioned between the first core 10 and the second core 112. The conductive coil 94 includes a passage 90 for receiving the center winding leg 64 of the first core 10 and the center winding leg 126 of the second core 112. The embodiment allows a magnetic field generated by the conductive coil 94 to induce a magnetic flux 100 through the cores 10, 112, as shown in FIG. 11B.

Figure 13:
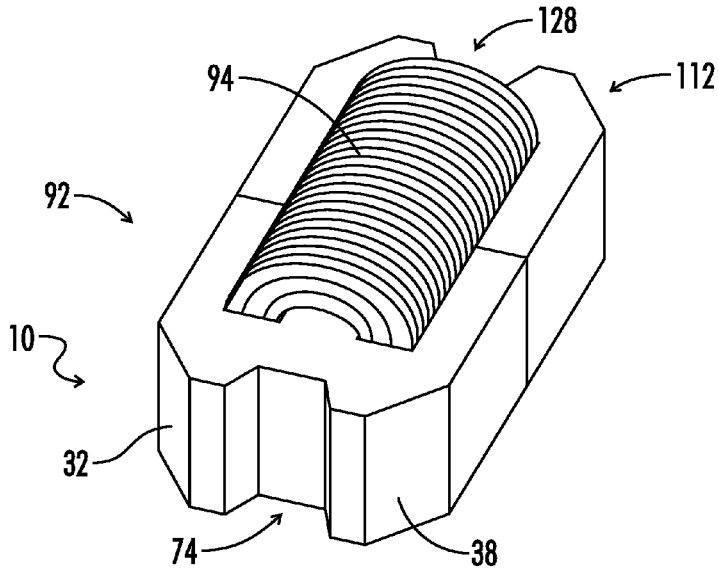
FIG. 13 is perspective view of a magnetic component consistent with the present invention.

Referring now to FIG. 13, one example of a magnetic component embodying the principles of the present invention, a transformer 92, is illustrated. The transformer includes a first core 10 having a notched recess 74, a first shoulder 32 and a second shoulder 38. The transformer 92 also includes a conductive coil 94 and a second core 112. The second core 112 may be formed in a variety of other shapes, including a traditional E core, a modified E core and a rectangular solid.

Figure 14:
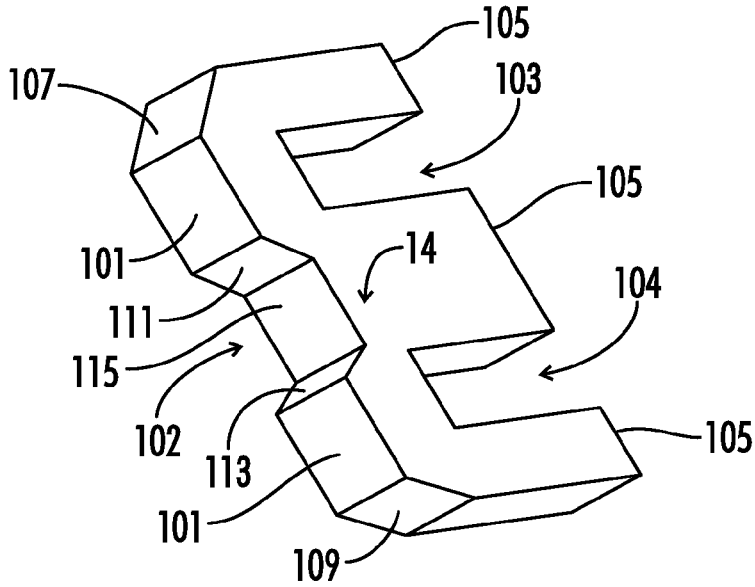
FIG. 14. is a perspective view of a core structure consistent with the present invention.

Referring now to FIG. 14, in an alternative embodiment further consistent with the present invention, the core body 14 includes a proximal end 101 and a distal end 105. A first groove 102 is positioned on the proximal end 101 of the core body 14. The first groove 102 defines the shape of a trapezoid. A second groove 103 and a third groove 104 are included on the distal end 105 of the core body 14. The second and third grooves 103, 104 each define the shape of a rectangle. A first shoulder 107 and a second shoulder 109 are also positioned on the proximal end 101 of the core body 14. The first groove 102 includes a first groove primary wall 111, a first groove secondary wall 113 and a first groove middle wall 115. In one embodiment, the first groove primary wall 111 is oriented at an obtuse angle relative to the first groove middle wall 115.

Thus, although there have been described particular embodiments of the present invention of a new and useful Magnetic Component with a Notched Magnetic Core Structure it is not intended that such references be construed as limitations upon the scope of this invention except as set forth in the following claims.

What is claimed is:

1. A magnetic core structure for guiding a magnetic field, comprising:

a first core body having a first side surface, a second side surface opposite the first side surface, a top surface, a bottom surface opposite the top surface, a first end surface, and a second end surface opposite the first end surface, the first side surface including a first side surface primary region and a first side surface secondary region;

the first side surface of the core body defining a notched recess positioned opposite the center winding leg, the notched recess including a first notch wall, a second notch wall and a middle notch wall, each notch wall having a width and extending from the top surface of the core body to the bottom surface of the core body, the middle notch wall oriented in a plane parallel to the first side surface, the notched recess including an outer width and a depth;

the notched recess positioned on the first side surface so that the first side surface is bisected into the first side surface primary region and the first side surface secondary region;

a first shoulder disposed on the core body between the first side surface primary region and the first end surface, the first shoulder defining a first shoulder surface oriented at an acute angle relative to the first side surface primary region;

a second shoulder disposed on the core body between the first side surface secondary region and the second end surface, the second shoulder defining a second shoulder surface oriented at an acute angle relative to the first side surface secondary region;

a first leg extending from the second side surface of the core body adjacent to the first end surface of the core body, the first leg having the shape of a rectangular solid and including a top surface oriented substantially in the same plane as the top surface of the core body and a bottom surface oriented substantially in the same plane as the bottom surface of the core body, the first leg having a width;

a second leg extending from the second side surface of the core body adjacent to the second end surface of the core body, the second leg having the shape of a rectangular solid and including a top surface oriented in the same plane as the top surface of the core body and a bottom surface oriented in the same plane as the bottom surface of the core body, the second leg having a width substantially equal to the width of the first leg;

a center winding leg extending outward from the second side surface of the core body positioned between the first leg and the second leg, the center winding leg having a top surface oriented in the same plane as the top surface of the core body and a bottom surface oriented in the same plane as the bottom surface of the core body, the center winding leg having a width substantially equal to twice the width of the first leg;

the outer width of the notched recess extending within ten percent of the width of the center winding leg;

the depth of the notched recess extending less than one-half the width of the core body;

the width of the middle notch wall extending substantially one-half the width of the center winding leg, the middle notch substantially centered opposite the center winding leg;

the first notch wall and the second notch wall being oriented at substantially the same obtuse angle relative to the middle notch wall; and the core body, first leg, second leg and center winding leg comprising ferrite.

2. The magnetic core structure of claim 1, further comprising:

a second ferrite core body positioned adjacent to the first leg, second leg and center winding leg; and a conductive coil disposed about the center winding leg.

3. The magnetic core structure of claim 2, wherein the center winding leg defines an air gap between the center winding leg and the second ferrite core body.

* * * * *